United States Patent [19]

Hanson

[11] 4,376,360

[45] Mar. 15, 1983

[54] ACCESS DOOR ASSEMBLY FOR A SILO

[75] Inventor: Newell B. Hanson, Lake Lillian, Minn.

[73] Assignee: Hanson Silo Company, Lake Lillian, Minn.

[21] Appl. No.: 228,134

[22] Filed: Jan. 26, 1981

[51] Int. Cl.[3] ..... E04H 7/00

[52] U.S. Cl. ..... 52/193; 52/196

[58] Field of Search ..... 52/192, 193, 196; 49/394, 34; 182/72

[56] References Cited

U.S. PATENT DOCUMENTS

| | | | |
|---|---|---|---|
| 952,876 | 3/1910 | Clark et al. . | |
| 1,218,240 | 3/1917 | Cronemeyer . | |
| 1,381,894 | 6/1921 | Stafford | 49/34 |
| 2,068,972 | 1/1937 | Bangert | 52/193 |
| 2,153,473 | 4/1939 | Mott . | |
| 2,322,923 | 6/1943 | Craine . | |
| 2,341,763 | 2/1944 | Craine . | |
| 2,367,720 | 1/1945 | Goldberg . | |
| 3,709,345 | 1/1973 | Price | 52/196 X |
| 3,997,025 | 12/1976 | Price . | |
| 4,271,632 | 6/1981 | Vanderloop . | |

*Primary Examiner*—Price C. Faw, Jr.
*Assistant Examiner*—Carl D. Friedman
*Attorney, Agent, or Firm*—Merchant, Gould, Smith, Edell, Welter & Schmidt

[57] ABSTRACT

The present invention is directed to an access door assembly (10) comprised of a frame assembly (12) held in place by a plurality of hoop-shaped rods (14). A door (16) is hinged to frame assembly (12) using a pair of first hinge brackets (18) secured to frame assembly (12), a pair of second hinge brackets (20) secured to door (16) near its vertical centerline, and a connecting rod (22) acting as the hinge pin between the first and second hinge brackets (18, 20). A latch mechanism (24) engages a mid-step member (26) to secure door (16) tightly against a door frame structure (28). In doing so, flexible door (16) bends to conform generally to the curvature of cylindrical silo wall (30).

Upper and lower step members (56, 58) are a part of frame assembly (12) and mid-step member (26) is supported by frame assembly (12). Hence the step members acting as ladder rungs are not supported by door (16), but rather by its frame.

8 Claims, 7 Drawing Figures

FIG. 4
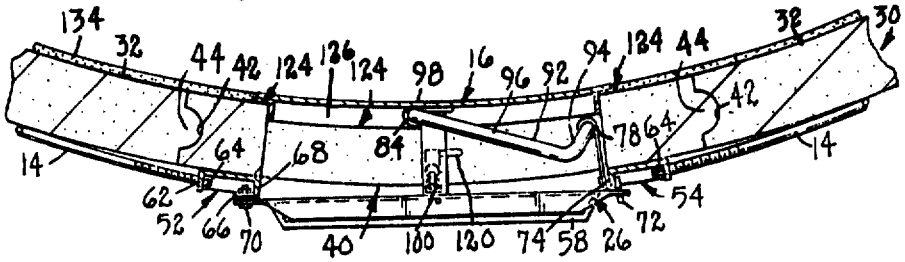
FIG. 5
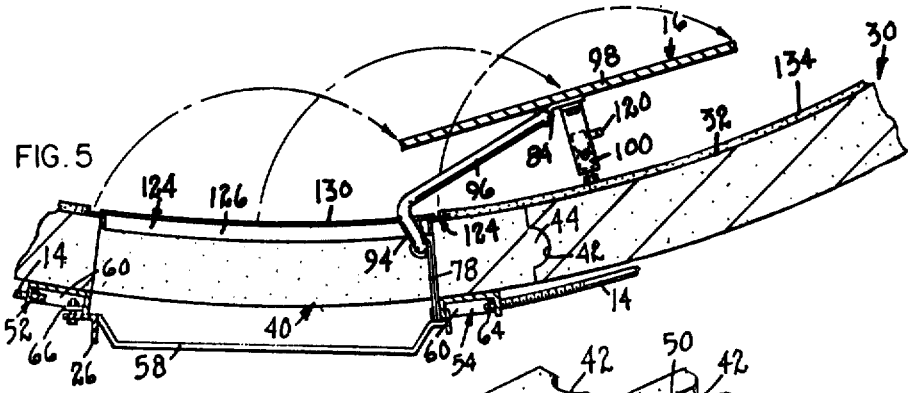
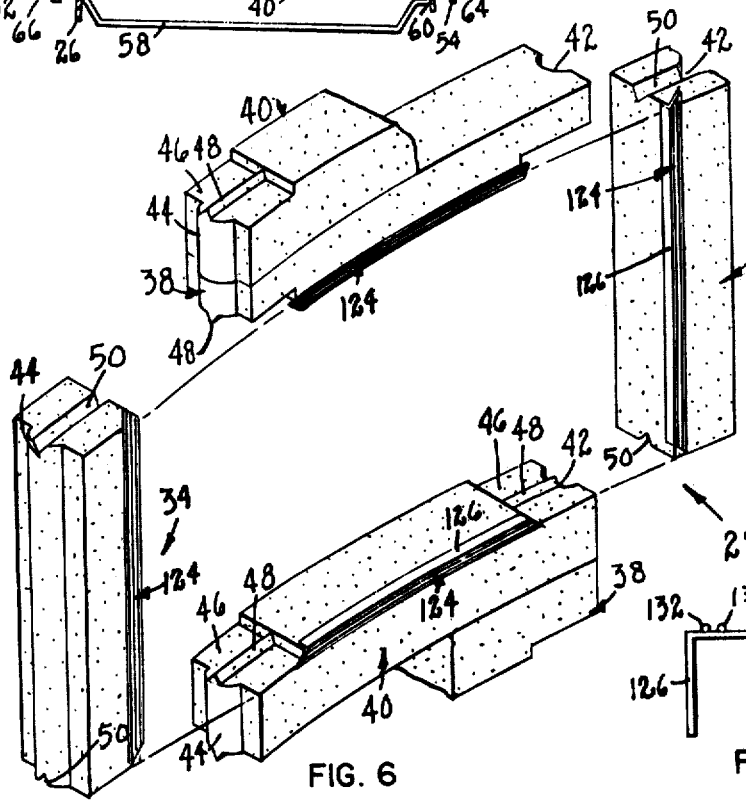
FIG. 6
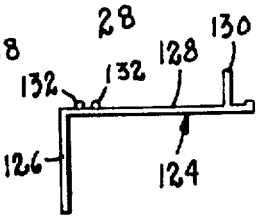
FIG. 7

ACCESS DOOR ASSEMBLY FOR A SILO

TECHNICAL FIELD

This invention relates to an access door assembly for a silo and, more particularly, to an assembly wherein the door frame, not the door, supports all step members and wherein the door locking sub-assembly engages one of the step members and provides a visable means for determining the locked or unlocked status of the door.

BACKGROUND OF THE INVENTION

Access to the interior of a forage-holding silo has commonly been through openings in the generally cylindrical wall of the silo. The openings are commonly vertically aligned and separated only by sufficient wall material to support the next higher door structure covering the next higher opening. Ladder rungs have been attached to the outside of known doors in order that a ladder along the outer surface of the silo exists for the purpose of climbing to the openable door immediately above the level of forage in the building. Generally, ladder rungs have been attached to the door itself resulting in a dangerous situation whenever the hinges or some other part of the door becomes worn due to age or disrepair. Thus, with such door assemblies, it is possible that the weight of a person on one of the ladder rungs could cause the hinge or some other portion of the door to yield or otherwise fail and endanger the person.

U.S. Pat. No. 3,997,025 addressed this problem by disclosing an assembly having hinge connecting members function as ladder rungs by extending between the hinge attachment to the door frame structure near one side of the door and the hinge attachment to the door near the other side of the door. A drawback of this system is that the ladder rungs disappear into the interior of the silo when a particular door is opened.

Various silo door latching assemblies have also been known. Most latches close the door sufficiently tight to seal the edges to the door frame. A common latch requires a removable wooden door to be placed between a vertically oriented rod and the door frame. The rod is inserted in openings in the upper and lower frame members. Due to the shape of the rod, when it is rotated approximately 180°, it cams the door tightly against the frame.

U.S. Pat. No. 3,997,025 shows another form of latch mechanism. A clamp arm is rotatably attached at its center to the door. At its ends, the clamp arm fits over the frame edges at the outer side of the silo. A pivotal locking bar cams the clamp arm tight thereby pulling the door tight against the inner side of the door frame. A drawback of this mechanism is that any loosening of the wingnut holding the locking bar to the clamp arm results in an easing of the tightness with which the door may be closed and sealed.

The present invention solves these and other problems present in prior art door assemblies.

SUMMARY OF THE INVENTION

The present invention is directed to an access door assembly for use as a closure for an access opening in a silo. The assembly comprises a door, frame means attached to the silo for supporting the door, hinge means for swingably attaching the door to the frame means, and means for latching the door closed. The frame means includes a pair of laterally spaced, vertical members and a pair of vertically spaced, upper and lower step members extending therebetween. When the door is closed with an access door assembly of this type, the door closes the access opening and the step members form a portion of a ladder along the silo.

In a preferred embodiment, the access door structure is a part of the generally cylindrical silo wall. The door structure includes a pair of laterally spaced, vertical columns and a pair of vertically spaced, top and bottom beams extending between the vertical columns. The columns and beams are ordinarily made from a cement material and are formed to interlock with the staves of the cylindrical wall. The columns and beams define an access opening in the silo. The door frame for supporting the door has an aperture which is aligned with the access opening defined by the columns and beams. The door frame includes a pair of laterally spaced, vertical members and a pair of vertically spaced, upper and lower step members extending between the vertical members. Hoop-shaped rods encircle the silo to retain the wall against the outwardly exerted pressure of the forage stored within. A plurality of hoop-shaped rods are adjustably fastened to the door frame and hold it in its properly aligned orientation with respect to the access opening.

The silo door is preferably stainless steel to avoid corrosion. The door fits tightly against a seal member at the edges of the access opening along the inside wall of the silo. A pair of first hinge brackets are secured to one of the vertical members of the door frame. A pair of second hinge brackets are secured approximately along the vertical centerline of the door. The first and second hinge brackets are vertically spaced. A connecting rod having a plurality of bends extends between the first and second sets of hinge brackets. The rod includes first and second end portions for engaging the first hinge brackets and a central portion separated from the end portions by arm portions. The central portion of the connecting rod is secured to the door by the pair of second hinge brackets. The connecting rod cooperates with the first and second hinge brackets to swingably move the door between open and closed orientations.

The latching mechanism of the access door assembly makes use of a mid-step member which is supported by the frame assembly. The mid-step member is rotatably attached at one end to one of the vertical members of the frame assembly. The other vertical member has a cradle element for releasably supporting the other end of the mid-step member. The mid-step member has a notch opening near its lateral center which performs a latching function.

A V-shaped strap is attached to the door at the attachments of the second hinge brackets. The apex of the V extends away from the door. A first cam member is attached to the strap and has a ramp surface facing the door. A second cam member has a handle. The second cam member has a ramp surface facing the ramp surface of the first cam member. A bolt and nut combination loosely holds the first and second cam members together. To latch the door closed, the door is snugged against the column and beam structure. The head of the bolt is inserted in the notch of the mid-step member. The handle on the second cam member is then rotated downwardly so that the complimentary ramp surfaces engage and force the door to seal closed. As the door tightens, the stainless steel door bends and conforms approximately to the curvature of the silo walls.

Access door assemblies in accordance with this invention include many advantages. For the functions performed, the present assembly is comprised of a minimal number of parts which are arranged in a non-complex fashion.

Problems or drawbacks of the prior art are solved. The assembly includes a plurality of reliable and safe steps which are supported by the door frame, rather than the door itself.

It is particularly advantageous that the locking system does not depend on the torque-level of a nut and bolt combination. Rather, complimentary camming surfaces are engaged by a handle which displays a characteristic open or closed position. In addition, the door itself is characteristically straight when opened and curved when closed.

The door assembly has the further advantage that the hinge elements cooperate to allow the connecting rod to swing the door inwardly and away from the access opening thereby providing the entire opening for functional use. Ordinarily, the mid-step member is rotated out of the way, however, it can be engaged by the cradle and used in conjunction with the upper and lower step members to complete the ladder and allow a person to climb the silo wall to a height above the open door.

For a better understanding of this invention, these and other advantages, and objects obtained by its use, reference should be had to the drawings which form a further part hereof and to the accompanying descriptive matter in which there is illustrated and described a preferred embodiment of the invention.

BRIEF DESCRIPTION OF THE DRAWINGS

FIG. 4 is a top, cross-sectional view of the assembly, taken along line 4—4 of FIG. 1, showing the door in the closed orientation;

FIG. 5 is similar to FIG. 4 except the door is shown in the open orientation; and FIG. 6 is an exploded, perspective view of the columns and beams comprising the access door assembly structure; and FIG. 7 is a cross-sectional detail view of the door seal member.

DETAILED DESCRIPTION OF THE INVENTION

Figure 1:
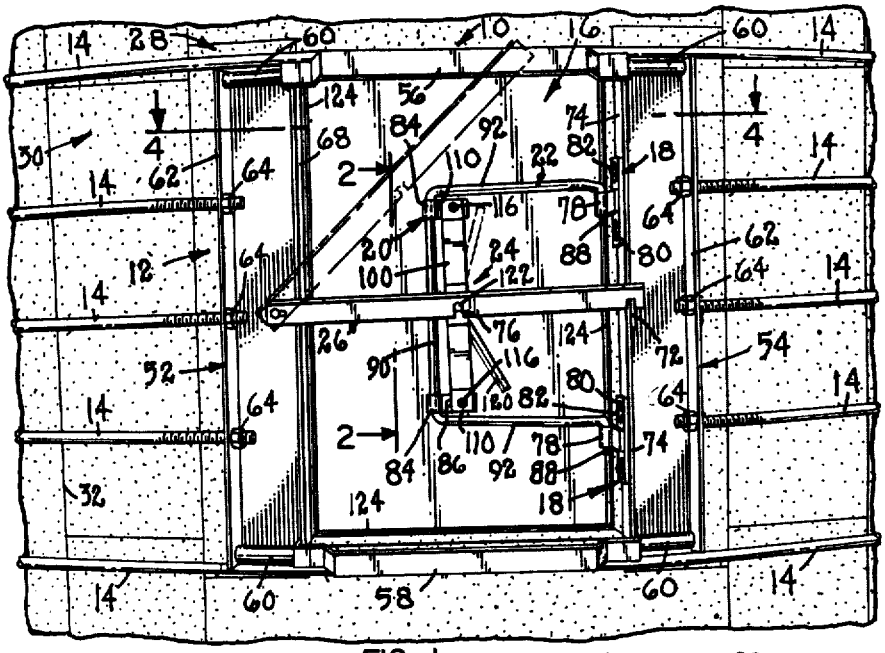
FIG. 1 is a front view of an access door assembly in accordance with the present invention.

Referring now to the drawings wherein like reference numerals designate identical or corresponding parts throughout the several views, and more particularly to FIG. 1, an access door assembly in accordance with the present invention is designated generally as 10. Access door assembly 10 is comprised of a frame assembly 12 held in place by a plurality of hoop-shaped rods 14. Door 16 is hinged to frame assembly 12 using a pair of first hinge brackets 18 secured to frame assembly 12, a pair of second hinge brackets 20 secured to door 16 near its vertical centerline, and a connecting rod 22 acting as the hinge pin between the first and second hinge brackets 18 and 20. A latch mechanism 24 engages a mid-step member 26 to secure door 16 tightly against a door frame structure 28 (see FIG. 6) which forms a part of the generally cylindrical silo wall 30. It is to be understood that the hinging mechanism may operate as well with single first and second hinge brackets 18 and 20.

Silos are commonly constructed to have a cylindrical shape. In recent years, silos have been built using concrete staves 32 which have interlocking ends and sides. The cylindrical shape provides sufficient structure to prevent the silo wall from collapsing inwardly. A plurality of hoops 14 encircle the silo wall 30 and prevent the silo from exploding outwardly due to the force of stored forage. In accordance with the present invention, a structure like that shown at 28 is installed among staves 32 to define access openings within the cylindrical wall 30 of a silo. Ordinarily, a plurality of structures 28 are vertically aligned to provide a plurality of vertically aligned access openings.

As shown in FIG. 6, access opening structure 28 is comprised of a pair of laterally spaced, vertical columns 34 and 36 and a pair of vertically spaced, top and bottom beams 38 and 40, respectively. Note that a bottom beam 40 sits directly on a top beam 38 of the next lower access opening structure 28. The vertical columns, such as 36, have a socket 42 along the side opposite the access opening. The socket 42 mates with a ball 44 of a stave 32 as shown in FIG. 4. A similar ball in socket relationship exists between column 34 and its mating stave. Similarly, the ends of beams 38 and 40 have ball and socket shapes 44 and 42, respectively, for engaging the corresponding ball or socket in mating staves 32. The upper side of lower beam 40 is the same as the lower side of upper beam 38. A portion 46 of each end is recessed with a tongue 48 protruding from the recess. Recess portion 46 is approximately the same size as an end of a vertical column 34 or 36. The ends of the vertical columns 34 and 36 have a groove 50 for engaging the tongues 48 of the beams 38 and 40. Thus, vertical columns 34 and 36 engage staves 32 as well as upper and lower beams 38 and 40. The sides of the columns and beams which define the access opening are relatively smooth. It is to be understood, of course, that the interlocking arrangement is exemplary only and could be accomplished in a variety of other fashions apparent to those skilled in the art.

Seal members 124 are fastened with an adhesive or other mechanism to the inside edge of columns 34 and 36 and beams 38 and 40 which together define an access opening. Preferably, a seal member 124 has a substantially L-shaped cross-sectional shape. The short leg 126 of the L-shape extends along the sides of the access opening. The long leg 128 of the L-shape extends along the inner surface of silo wall 30. An end portion 130 of long leg 128 is J-shaped. End portion 130 is located near the end of long leg 128 opposite from the end adjacent short leg 126 of seal member 124. The base portion of the J-shaped end portion 130 is integral with long leg 128. The upright portions of J-shaped end portion 130 extend in a direction opposite that of short leg 126. One or more beads 132 of soft vinyl are co-extruded to long leg 128 near the end attached to short leg 126 but on the opposite side of long leg 128 as short leg 126.

Seal member 124 is adhesively or otherwise fastened in place relative to the access opening as described hereinbefore. A finishing material 134 is then applied to the inner surface of silo wall 30 (see FIGS. 4 and 5). Finishing material 134 fills the trough portion of J-shape end portion 130 and is applied to a thickness approximately the same as the length of the longer leg of J-shaped end portion 130. After finishing material 134 is applied, the plurality of seal members 124 about an access opening provide a notched perimeter about the opening. Flexible door 16 fits within the notched perimeter and upon latching seals tightly against soft vinyl beads 132.

Frame assembly 12 is comprised of a pair of laterally spaced, vertical members 52 and 54 and a pair of horizontally spaced, upper and lower step members 56 and 58 extending therebetween. Vertical members 52 and 54 are channels having rods or plates 60 to provide structural strength extending between the channel walls at the upper and lower ends. In the embodiment shown in FIG. 1, the outer walls 62 of vertical members 52 and 54 have a plurality of evenly spaced openings for acceptance of the ends of hoop-shaped rods 14. One such opening is vertically centered on the vertical members 52 and 54 while the other two openings are centered between the center opening and the ends of the vertical members 52 and 54. The ends of hoop-shaped rods 14 are threaded and adjustably retained to outer walls 62 by nuts 64.

Upper and lower step members 56 and 58 are made from sufficiently thick sheet material and have width of sufficient dimension to provide necessary structural strength. The ends of upper and lower step members 56 and 58 are welded or otherwise fastened to the upper and lower ends of vertical members 52 and 54, respectively. Step members 56 and 58 have a plurality of bends which result in the center portion of step members 56 and 58 being spaced from the silo wall 30 in order that a person may easily place his foot on the step members 56 and 58 when using them as ladder rungs.

Mid-step member 26 is rotatably attached to vertical member 52. A tab 66, as shown in FIG. 4, is welded or otherwise attached at a slightly greater than 90° angle from the inner wall 68 of vertical member 52. Tab 66 extends generally in the direction of outer wall 62. Mid-step member 26 is rotatably attached to tab 66 with a nut and bolt combination 70 or some other equivalent fastening mechanism. A cradle member 72 is welded or otherwise attached near the vertical center of inner wall 74 of vertical member 54. Cradle member 72 extends outwardly from inner wall 74 and includes a slot in its upper edge to accept and retain the end of mid-step member 26. When mid-step member 26 is cradled in cradle member 72, it is approximately parallel with upper and lower step members 56 and 58. Mid-step member 26, in the embodiment described, is an angle piece having one leg of the angle extending outwardly and the other leg of the angle extending downwardly. An open-ended, vertically oriented slot 76 (see FIG. 1) is formed near the lateral center of the downwardly extending leg of mid-step member 26. The function of slot 76 is described hereinafter.

Mid-step member 26 is spaced from door 16 since it is attached somewhat outwardly from the ends of the channel walls 68 and 74 of vertical members 52 and 54. In this fashion, mid-step member 26 is spaced from the general surface curvature of the silo approximately the same distance as are upper and lower step members 56 and 58. Mid-step member 26 is approximately centered between upper and lower step members 56 and 58. Note, also, that the distance represented by the combined widths of beams 38 and 40 is roughly the same as the distance between upper or lower step members 56 and 58 and mid-step member 26. Thus, the distance between the upper step member 56 of the next lower access door assembly and the lower step member 58 of the assembly 10 shown is roughly the same as the distance between upper and lower step members 56 and 58 and mid-step member 26. Hence, the various step members of each of the vertically-aligned, access door assemblies on a silo wall result in a ladder structure having roughly equivalent spacing between the various ladder rung members.

First hinged brackets 18 are identical and vertically-spaced (see FIG. 1). A hinge bracket 18 is made from a T-shaped sheet material. The lower end 78 of the T is cylindrically bent to accept the end portions of connecting rod 22. At the ends of the cross-portion of the T are slots 80. First hinge brackets 18 are fastened at slots 80 with nut and bolt combinations 82 to inner wall 74 of vertical member 50. Slots 80 allow vertical adjustment of hinges 18. Base end 78 of hinge 18 extends inwardly along the access opening edge of vertical column 36.

Second hinge brackets 20 are also identical and vertically spaced approximately the same distance as first hinge brackets 18. A second hinge bracket 20 is made from a sheet material and has a semi-cylindrical bend at one end 84. A slotted opening 86 is formed at the other end. Slotted openings 86 allow horizontal adjustment. Hence, the vertical adjustment available with slots 80 in first hinge brackets 18 and the horizontal adjustment available with slots 86 in second hinge brackets 20 allow considerable and convenient adjustability of the door, hinge, and latch mechanisms with respect to frame assembly 12.

Connecting rod 22 is substantially U-shaped. The two end portions 88 extend downwardly from what would otherwise be the ends of the U-legs. End portions 88 are received within the cylindrical openings offered by ends 78 of first hinge brackets 18. The central or base portion 90 of U-shaped connecting rod 22 is separated from end portions 88 by arm portions 92. Semi-cylindrical ends 84 of second hinge brackets 20 clamp the central portion 90 against the outer surface of door 16 to hold central portion 90 securely to door 16. In this fashion, connecting rod 22 cooperates with the first and second hinge brackets 18 and 20 to swingably hold the door 16.

As shown in FIGS. 4 and 5, arm portions 92 are L-shaped, having the angle portion of the L extending outwardly from door 16 and being located relatively near the first hinged brackets 18. In this fashion, when door 16 is opened as shown in FIG. 5, the shorter portion 94 of the L reaches from first hinge bracket 18 inwardly to beyond the inward surface of the silo wall. The longer portion 96 of the L extends to second hinge brackets 20 so as to hold doors 16 away from the access opening. Since the central portion 90 of connecting rod 22 can rotate within the semi-cylindrical end portion 84 of second hinge brackets 20, door 16 rotates with respect to connecting rod 22 as the door opens and, hence, the inner surface 98 of door 16 always stays inwardly.

Figure 2:
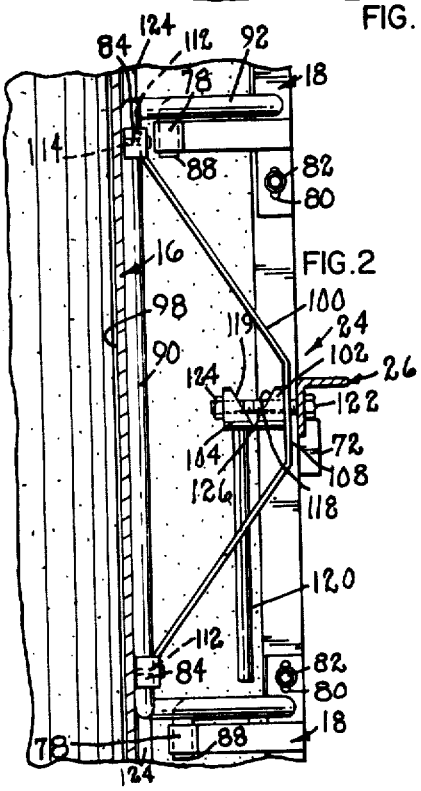
FIG. 2 is a side, cross-sectional view of the assembly, taken along line 2—2 of FIG. 1, showing the door in the closed orientation.

As shown in FIGS. 1 and 2, latch mechanism 24 is comprised of a strap 100 and a pair of cam members 102 and 104 held together by a locknut 124 and bolt 122 to cooperate with slot 76 in mid-step member 26. Strap 100 is made from a sheet material and formed into a substantially V-shape. The apex portion 108 of the strap 100 is spaced from door 16 and is flat rather than pointed. The ends 110 of strap 100 are essentially parallel with the flat portion of apex 108. Openings near ends 110 are aligned with slots 86 of second hinge brackets 20 and with openings 112 in door 16 shown in phantom lines in FIGS. 2 and 3. The openings 112 in door 16 are countersunk from the inside surface 98. Bolts 114 pass through the indicated aligned openings and are secured with nuts 116 to compactly hold second hinge brackets 20, connecting rod 22, aand strap 100. Bolts 114 are countersunk to prevent rotating machinery within the silo from catching on protruding bolt heads.

Figure 3:
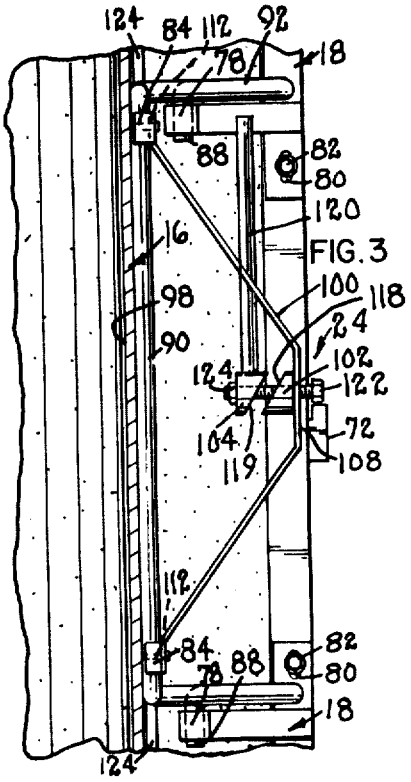
FIG. 3 is similar to FIG. 2 except the latch mechanism is shown in the open orientation.

Cam member 102 is welded or otherwise fastened to the inner side of the flat portion of apex 108 of strap 100. Cam member 102 is cylindrical and has a ramp surface 118 at one end which faces door 16. Cam member 104 has a ramp surface 119 which faces ramp surface 118 of cam member 102. Cam member 104 is otherwise similar to cam member 102. A handle 120 is welded or otherwise fastened to the side wall of cam member 104. An axial opening passes through each of cam members 102 and 104 and is aligned with a similarly sized opening in the flat portion of apex 108. A bolt 122 passes through the aligned openings and is held loosely in place with locknut 124. Ramp surfaces 118 and 119 are loose with respect to one another when handle 120 is upwardly as in FIG. 3. Thus, with the head of bolt 122 retained in slot 76 of mid-step member 26, when handle 120 is rotated downwardly ramp surfaces 118 and 119 come into at least partial contact and react against one another to force cam member 104 toward door 16. With handle 120 substantially downwardly, ramp surfaces 118 and 119 contact each other at a common end point 126 only, as shown in FIG. 2.

FIG. 5 shows access door assembly in an open configuration. Mid-step member 26 is hanging downwardly. The door assembly is closed and latched in accordance with the following procedure. Mid-step member 26 is rotated upwardly in order to be cradled in cradle member 72 as shown in FIGS. 1 and 4. Door 16 is swung closed. While swinging, connecting rod 22 rotates in both first and second hinge brackets 18 and 20 keeping the inner surface 98 of door 16 inwardly. Mid-step member 26 is lifted slightly to allow bolt 122 to be received within slot 76. Handle 120 is rotated from an upwardly orientation as in FIG. 3 to a downwardly orientation as in FIG. 2. Cam members 102 and 104 react against one another to expand the distance between the non-contacting ends. This causes the apex portion 108 of strap 100 to tighten against mid-step member 26. At the same time, the edges of door 16 press tightly against seal member 124. The vertical spacing between bolts 114 fastening the ends 110 of strap 100 to door 16 causes door 16 to bend along the line between bolts 114 since the edges of door 16 are retained against vertical columns 34 and 36. Hence, door 16 assumes a curvature substantially similar to the internal curvature of the silo. Thus, the closed orientation of door 16 is characterized by handle 120 extending downwardly and by door 16 assuming the general curvature of the silo wall 30.

Door 16 is opened by reversing the above procedure. It has been found that 12 gauge (0.109 inch) stainless steel is an acceptable thickness for door 16 to accomplish an efficient seal at the edges while at the same time allowing door 16 to bend to the desired curvature. It has been found also that various alloys are preferable materials for frame assembly 12, hoop-shaped rods 14, first and second hinge brackets 18 and 20, connecting hinge pin rod 22, latch mechanism 24, and mid-step member 26. It is to be understood, however, that steel alloy materials are not exclusive and that other materials may function equally well.

Thus, the disclosed access door assembly 10 is easily operable to perform its objectives efficiently and reliably. It is to be understood, however, that although numerous characteristics and advantages of the invention have been set forth in the foregoing description, together with details of structure and function of the invention, that the disclosure is illustrative only. Any changes made, especially in matters of shape, size, and arrangement of parts, to the full extent extended by the general meaning of the terms in which the appended claims are expressed, are within the principle of the invention.

What is claimed is:

1. An access door assembly for use a closure for an access opening in a silo, said silo having a cylindrical wall retained in place by a plurality of surrounding hoops to prevent outward expansion, said assembly comprising:

a door;

frame means, attached to said silo with said hoops, for supporting said door, said frame means including a pair of laterally spaced, vertical members and vertically spaced step members attached thereto and extending therebetween whereby said frame means also supports said step members, said step members being spaced outwardly from said silo wall and said hoops across said access opening to provide a useable ladder for said silo, one of said step members being rotatably attached to said frame means thereby allowing more complete use of said access opening;

hinge means for swingably attaching said door to said frame means; and, means for latching said door closed, said latching means including a member attached to said door and means for releasably coupling said member to said one step member;

whereby when said door is closed, said door closes said access opening and said step members form a ladder supported by said frame means along said silo.

2. An access door assembly in accordance with claim 1 wherein said latch means includes said-one step member supported by said frame means, said one step member having first and second ends, said latch means including means for rotatably attaching said one step member at said first end to said frame means and means attached to said frame means for releaseably holding said one step member at said second end.

3. An access door assembly in accordance with claim 2 wherein said latch means includes a strap attached to said door and cam means for tightening said strap securely to said mid step member.

4. An access door assembly in accordance with claim 3 wherein said camming means includes a first cam member affixed to said strap, said first cam member having a ramp surface facing said door, said camming means further including a second cam member having a ramp surface for complimentary engagement with the ramp surface of said first cam member.

5. An access door assembly in accordance with claim 4 wherein said latch means includes a bolt and nut combination for loosely holding said first and second cam members together, said combination also for engagement of said one step member, whereby when said door is open, said combination loosely holds said second cam member to said strap and first cam member and, when said door is latched closed, said combination engages said one step member and secures said strap to said one step member as said camming means is tightened.

6. An access door structure for a silo having a generally cylindrical wall, said structure comprising:

frame means for defining an access opening in said silo;

door means for covering said access opening, said door means including a flexible door, said door having a vertical centerline;

hinge means for swingably attaching said door means to said frame means, said hinge means including a pair of vertically spaced, first hinge brackets secured to said frame means, a pair of vertically spaced, second hinge brackets secured approximately along the vertical centerline of said door, and means for connecting said first hinge brackets to said second hinge brackets which allow said door to swingably pivot about both said first and second hinge brackets relative to said frame means; and means for latching said door means to said frame means, said door bending when said door is latched to a radius of curvature roughly similar to the radius of the wall of said silo, said latching means including a step member moveably supported by said frame means, said latching means further including a strap having first and second opposite ends connected to said second hinge brackets and means for tightening said strap securely to said member thereby bending said door to conform substantially to the wall of said silo.

7. An access door assembly for swingably closing an access opening in a silo, said silo having a generally cylindrical wall, said assembly comprising:

a flexible door for closing said access opening;

frame means for supporting said door, said frame means including a pair of laterally spaced, vertical members and a pair of vertically spaced, upper and lower step members extending therebetween;

hoop means for encircling said silo and securing said frame means to said silo;

a pair of first hinge brackets secured to one of said vertical members;

a pair of second hinge brackets secured to said door;

a connecting rod having a plurality of bends, said rod including first and second end portions for engagement with said pairs of first hinge brackets, said rod including a central portion separated from said end portions by arm portions, said central portion being secured to said door by said pair of second hinge brackets, said connecting rod cooperating with said first and second hinge brackets to swingably move said door between open and closed orientations relative to said access opening;

a mid-step member supported by said frame means, said mid-step member being rotatably attached at a first end to one of said vertical members of said frame means, the other of said vertical members having a receiving member for releasably supporting a second end of said mid-step member;

a strap attached to said door;

a first cam member attached to said strap and having a ramp surface facing said door;

a second cam member having a handle, said second cam member having a ramp surface facing the ramp surface of said first cam member;

fastening means for holding said first and second cam members together, whereby said fastening means holds said cam members loosely when said door is in an open orientation, while in a closed orientation allowing said second cam member to cooperate with said first cam member to tighten said strap securely to said mid-step member thereby bending said flexible door to a curvature substantially similar to that of said silo wall to hold said door securely.

8. A door assembly for an access opening in a silo, said assembly comprising:

a door for covering said access opening, said door having a vertically extending centerline;

frame means for supporting said door, said frame means including a pair of laterally spaced, vertical members and a pair of vertically spaced horizontal members extending therebetween, said frame means including upper and lower step members fixed to said frame means;

hoop means for encircling said silo and securing said frame means to said silo;

first hinge bracket means secured to one of said vertical members;

second hinge bracket means extending generally vertically near said door centerline, said second hinge bracket means being secured to said door;

a connecting rod having a plurality of bends, said rod including first and second end portions for engagement with said first hinge bracket means, said rod including a central portion separated from said end portions by arm portions, said central portion being secured to said door by said second hinge bracket means, said connecting rod cooperating with said first and second hinge bracket means to swingably move said door between open and closed orientations relative to said access opening;

a mid-step member supported by said frame means, said mid-step member being rotatably attached at a first end to one of said vertical members of said frame means, the other of said vertical members having a receiving member for releasably supporting a second end of said mid-step member; and means for latching said door, said latching means releasably connecting said door and said second hinge bracket means to said mid-step member.

* * * * *